US009871300B1

(12) United States Patent
Lee et al.

(10) Patent No.: US 9,871,300 B1
(45) Date of Patent: Jan. 16, 2018

(54) STEERABLE PHASED ARRAY ANTENNA

(71) Applicant: Amazon Technologies, Inc., Seattle, WA (US)

(72) Inventors: Tzung-I Lee, San Jose, CA (US); In Chul Hyun, San Jose, CA (US); Jin Kim, San Jose, CA (US)

(73) Assignee: Amazon Technologies, Inc., Seattle, WA (US)

( * ) Notice: Subject to any disclaimer, the term of this patent is extended or adjusted under 35 U.S.C. 154(b) by 17 days.

(21) Appl. No.: 15/081,720

(22) Filed: Mar. 25, 2016

(51) Int. Cl.
*H01Q 1/24* (2006.01)
*H01Q 13/26* (2006.01)
*H01Q 1/48* (2006.01)

(52) U.S. Cl.
CPC ..... *H01Q 13/26* (2013.01); *H01Q 1/243* (2013.01); *H01Q 1/48* (2013.01)

(58) Field of Classification Search
CPC ..... H01Q 1/48; H01Q 13/26; H01Q 1/243
USPC ..... 343/702
See application file for complete search history.

*Primary Examiner* — Graham Smith
(74) *Attorney, Agent, or Firm* — Lowenstein Sandler LLP

(57) ABSTRACT

Devices or apparatuses for adjusting a radiation angle of an antenna are described. An electronic device may include a strip, a first leaky-wave antenna (LWA) cell, and a second LWA cell. The first LWA cell can include a tunable component. The first LWA cell can also include a first conductive patch coupled to: a radio frequency (RF) feed on a first edge of the first conductive patch; a ground plane through a first via on a second edge of the first conductive patch; and a tunable component at a first corner between a third edge and a fourth edge of the first conductive patch. The second LWA cell can include a second conductive patch coupled to the ground plane through a second via on a second edge of the second conductive patch and coupled to the tunable component at a first corner between a first edge and a third edge of the second conductive patch.

20 Claims, 13 Drawing Sheets

STEERABLE PHASED ARRAY ANTENNA

BACKGROUND

A large and growing population of users is enjoying entertainment through the consumption of digital media items, such as music, movies, images, electronic books, and so on. The users employ various electronic devices to consume such media items. Among these electronic devices are electronic book readers, cellular telephones, personal digital assistants (PDAs), portable media players, tablet computers, netbooks, laptops and the like. These electronic devices wirelessly communicate with a communications infrastructure to enable the consumption of the digital media items. In order to wirelessly communicate with other devices, these electronic devices include one or more antennas.

BRIEF DESCRIPTION OF DRAWINGS

The present invention will be understood more fully from the detailed description given below and from the accompanying drawings of various embodiments of the present invention, which, however, should not be taken to limit the present invention to the specific embodiments, but are for explanation and understanding only.

DETAILED DESCRIPTION

Figure 1A:
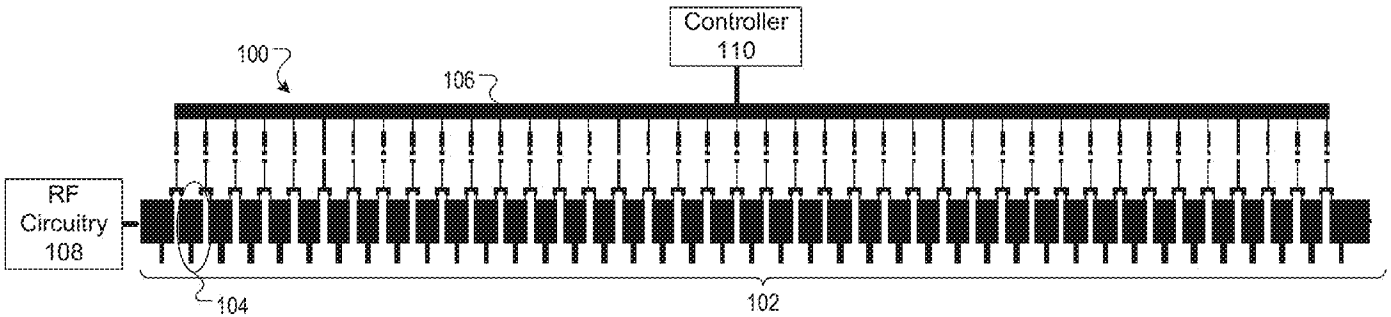
FIG. 1A shows a phased array antenna structure with a leaky wave antenna (LWA) cell group according to one embodiment.

Electronic devices traditionally use conventional antennas that may be externally mounted to the electronic devices (e.g., external antennas) to avoid interference from internal components and housings of the electronic devices. As electronic devices continue to be miniaturized, antennas may be integrated within the electronic devices to increase functionality and aesthetic design of the electronic devices.

With the integration of antennas into the electronic devices, different environments where the electronic devices are used and objects approximate the housings of the electronic devices may increase a level of interference for the integrated antennas when the electronic devices communicate data. For example, when an antenna of an electronic device is in close proximity to other objects, the other objects may interfere with signals being sent and/or received at the electronic device (e.g., signal interference and signal distortion). For example, when an antenna comes into close proximity of a human body or a metal object, such as within approximately 2-3 millimeters, signal interference and signal distortion can occur because energy that is intended to be transmitted (e.g., radiated away) from the electronic device to another device may be absorbed or scattered by the human body or the metal object. Where a human body is primarily water, when the water is located between a transmitting antenna and a receiving antenna, the water can interfere with the receiving antenna receiving a signal from the transmitting antenna.

In one example, a proximity of the electronic device to the object can interfere with communicating a signal between a transmitting antenna and a receiving antenna. In another example, an orientation of an antenna of the electronic device relative to the object or a communication tower can interfere with communicating a signal between a transmitting antenna and a receiving antenna. Interfering objects and varying orientation of the electronic device can reduce an antenna efficiency and a performance of an antenna when the electronic device is using the antenna to transmit and/or receive signals.

The embodiments described herein may address the above noted deficiencies by the electronic device including a phased array antenna structure that is steerable. The phased array antenna structure herein can utilize multiple leaky wave antenna (LWA) cells with tunable components and a controller to set a radiation angle of the phased array antenna. In one example, the controller can generate a control signal to electronically steer the LWA cells. One advantage of electronically steering the LWA cells can be to enable rapid changes to a radiation angle of the phased array antenna structure without moving large mechanical structures. For example, a phased antenna array structure can be used in a smart phone or tablet computing device to enhance signal strength and coverage of the electronic device while a user uses the smart phone or tablet computing device, such as while moving around. Other advantages of the phased array antenna structure can be to: increase an overall gain of a signal received by the electronic device; provide a diversity in transmission and reception angles of the electronic device; and cancel out or reduce an interference level for a signal.

The electronic device may be any content rendering device that includes a modem for connecting the electronic device to a network. Examples of such an electronic device include an electronic book reader, a portable digital assistant, a mobile phone, a laptop computer, a portable media player, a tablet computer, a camera, a video camera, a netbook, a notebook, a desktop computer, a gaming console, a Blu-ray® or DVD player, a media center, a drone, a speech-based personal data assistant, and the like. The electronic device may connect to a network to obtain content from a server computing system (e.g., an item providing system) or to perform other activities. The electronic device may connect to one or more different types of cellular networks.

Several topologies of antenna structures are contemplated herein. The antenna structures described herein can be used for wide area network (WAN) technologies, such as cellular technologies including Long Term Evolution (LTE®) frequency bands, third generation (3G) frequency bands, Wi-Fi® frequency bands or other wireless local area network (WLAN) frequency bands, Bluetooth® frequency bands or other personal area network (PAN) frequency bands, global navigation satellite system (GNSS) frequency bands (e.g., positioning system (GPS) frequency bands), and so forth. In one example, the LTE® frequency bands can include a B1 band, a B2 band, a B4 band, a B5 band, a B8 band, a B12 band, or a B17 band.

In another example, the cellular network employing a third generation partnership project (3GPP®) release 8, 9, 10, 11, or 12 or Institute of Electronics and Electrical Engineers (IEEE®) 802.16p, 802.16n, 802.16m-2011, 802.16h-2010, 802.16j-2009, 802.16-2009. In another example, the wireless network may employ the WI-FI® technology following IEEE® 802.11 standards defined by the WI-FI ALLIANCE® such as the IEEE® 802.11-2012, IEEE® 802.11ac, or IEEE® 802.11ad standards. In another example, the electronic device may use the antenna structure to communicate with other devices using a secure WLAN, secure PAN, or a Private WAN (PWAN). Similarly, the electronic device may use the antenna structure to communicate using a BLUETOOTH® technology and IEEE® 802.15 standards defined by the BLUETOOTH® Special Interest Group, such as BLUETOOTH® v1.0, BLUETOOTH® v2.0, BLUETOOTH® v3.0, or BLUETOOTH® v4.0 (including BLUETOOTH® low energy). In another embodiment, the electronic device may use the antenna structure to communicate using a ZIGBEE® connection developed by the ZIGBEE® Alliance such as IEEE® 802.15.4-2003 (ZIGBEE® 2003), IEEE® 802.15.4-2006 (ZIGBEE® 2006), IEEE® 802.15.4-2007 (ZIGBEE® Pro). The preceding frequency bands are not intended to be limiting. The electronic device can use the antenna structure to communicate on other frequency bands, such as GNSS frequency bands (e.g., GPS frequency bands), and so forth.

FIG. 1A shows a phased array antenna structure 100 with an LWA cell group 102 according to one embodiment. The phased array antenna structure 100 can include the LWA cell group 102, a strip 106, radio frequency (RF) circuitry 108, and a controller 110. The LWA cell group 102 can include multiple LWA cells 104. For example, the LWA cell group 102 can include multiple LWA cells 104 in a series or row. The multiple LWA cells 104 can be individually coupled to respective locations on a strip 106 of the phased array antenna structure 100. For example, each of the LWA cells 104 in the LWA cell group 102 can be coupled to the strip 106 and can be separated by approximately a 1 millimeter (mm) gap. In one example, the LWA cells 104 can be coupled to the strip 106 in a series. In another example, each of the LWA cells 104 can be approximately the same size and shape. The LWA cells 104 can be separated by gaps or spaces and can be inductively coupled together.

In one embodiment, an LWA cell 104 of the LWA cell group 102 can include one or more tunable components or varactors, as discussed in greater detail in the proceeding paragraphs. In one example, the LWA cell group 102 can be approximately 200 mm in length. The RF circuitry 108 can be coupled to the one or more of the LWA cells 104. For example, the RF circuitry 108 can be coupled to an LWA cell 104 at an end of a series of LWA cells 104. The RF circuitry 108 can be coupled to the LWA cell 104 via an RF feed.

The controller 110 can be coupled to the strip 106. In one embodiment, the controller 110 can generate a control signal with a voltage bias to set a radiation angle of the phased array antenna structure 100. The phased array antenna structure 100 can be part of an electronic device. The electronic device can have a processor or system on a chip (SoC) that can determine an angle to radiate electromagnetic energy. In one embodiment, the processor or the SoC can perform a sweep of multiple radiation angles to determine a preferred radiation angle to radiate the electromagnetic energy. For example, the processor or SoC can send an instruction to the controller 110 to apply a voltage bias to the tunable components of the LWA cells 104 to adjust a radiation angle of the phased array antenna structure 100. To sweep the multiple radiation angles, the processor can send a first instruction to the controller 110 to adjust the radiation angle to a first radiation angle and radiate the electromagnetic energy, send a second instruction to the controller 110 to adjust the radiation angle to a second radiation angle and radiate the electromagnetic energy, send a third instruction to the controller 110 to adjust the radiation angle a third radiation angle and radiate the electromagnetic energy, and so forth for multiple radiation angles. To set the radiation angles, the controller 110 sends an voltage bias to change a voltage value of a tunable component to a voltage value correlated to the given radiation angle of the phased array antenna structure. For example, the phased array antenna structure 100 can have multiple tunable components that each has an initial voltage value of 1 volt (V). When the tunable components are each set to 1V the phased array antenna structure 100 can radiate electromagnetic energy at 15 degrees. A processor or a SoC can determine than an RSSI is highest when the phased array antenna structure 100 radiates electromagnetic energy at a 42 degree radiation angle, as discussed in greater detail in the proceeding paragraphs. The processor or SoC can look up a voltage value, such as in a database or memory device, that correlates with the 42 degree radiation angle and instruct the controller 110 to set the tunable components to the voltage value. The controller 110 can then apply a voltage bias to each tunable component to set the voltage value that correlates to the 42 degree radiation angle. When the voltage value of each tunable component is set, an electronic device can use the phased array antenna structure 100 to radiate electromagnetic energy at a 42 degree radiation angle.

The processor or SoC can take measurements for each of the radiation angles and select a preferred radiation angle. In one example, the measurements can be signal strength measurements, such as a received signal strength indicator (RSSI) measurements, a reference signal received power (RSRP) measurements, a reference signal received quality (RSRQ) measurements, and so forth. In another example, the measurements can be signal-to-noise ratio (SNR) measurements. In one embodiment, the processor or SoC can compare the measurements for each of the radiation angles and select radiation angle with a highest signal strength measurement associated with it. In another embodiment, the processor or SoC can compare the measurements for each of the radiation angles and select radiation angle with a lowest SNR measurement associated with it.

In one embodiment, the strip 106 can be a non-radiating conductive strip that can conduct control signals from the controller 110 while not radiating electromagnetic energy when the RF circuitry 108 applies a current to a LWA cell 104 to cause the LWA cell group 102 to radiate electromagnetic energy. In one example, the RF circuitry 108 can apply a first current to the RF feed to cause the phased array antenna structure 100 to radiate electromagnetic energy at a first angle when the control signal is set to a first radiation angle. The RF circuitry 108 can apply a second current to the RF feed to cause to the phased array antenna structure to radiate electromagnetic energy in a second direction when the control signal is set to a second radiation angle.

Figure 1B:
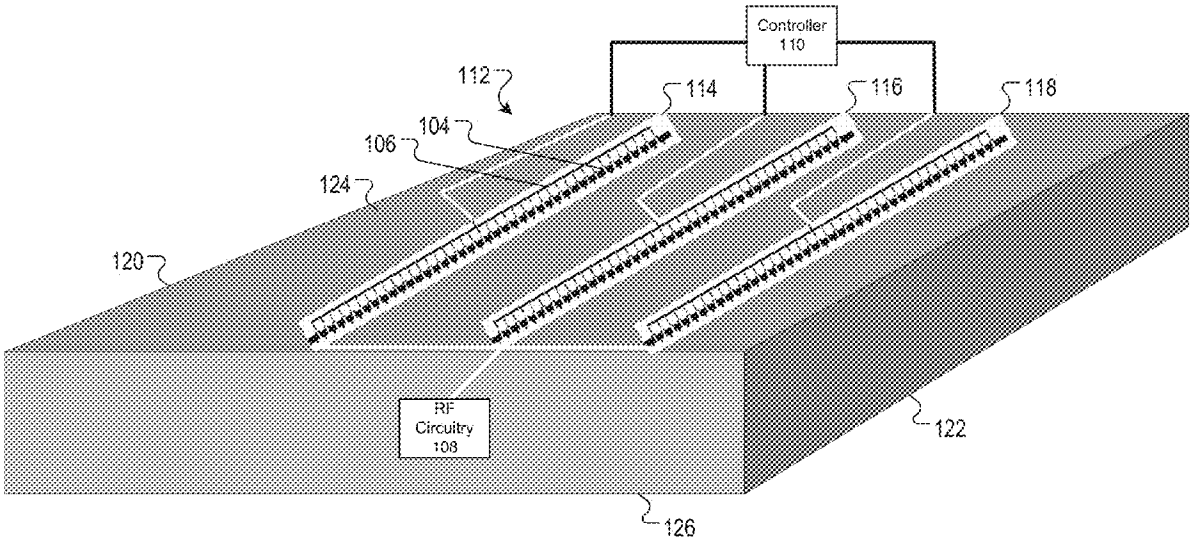
FIG. 1B shows an antenna structure with multiple LWA cell groups according to one embodiment.

FIG. 1B shows a phased array antenna structure 112 with multiple LWA cell groups 114-118 according to one embodiment. Some numbers in FIG. 1B are similar to some numbers in FIG. 1A as noted by similar reference numbers unless expressly described otherwise. The phased array antenna structure 112 can include the LWA cell groups 114-118, a substrate 120, and a ground plane 122. The LWA cell groups 114-118 can be coupled or attached to a top surface 124 of the substrate 120. The ground plane 122 can be coupled or attached to a bottom surface 126 of the substrate 120. In one example, the substrate 120 can be approximately 1.5 mm thick.

The LWA cell groups 114-118 can each have one or more LWA cells. Each of the LWA cells can be connected to the ground plane by a via in the substrate 120. The controller 110 can be coupled to each of the strips of the LWA cell groups 114-118 to generate a control signal to set a radiation angle of the each of the LWA cell groups 114-118. In one embodiment, the controller 110 can set the radiation angle of each of the LWA cell groups 114-118 to be the same angle. In another embodiment, the controller 110 can set the radiation angle of one or more of the LWA cell groups 114-118 to be different angles. For example, the controller can set the LWA cell group 114 to radiate electromagnetic energy at a 15 degree angle, the LWA cell group 116 to radiate electromagnetic energy at a 45 degree angle, and the LWA cell group 118 to radiate electromagnetic energy at a 78 degree angle.

Figure 1D:
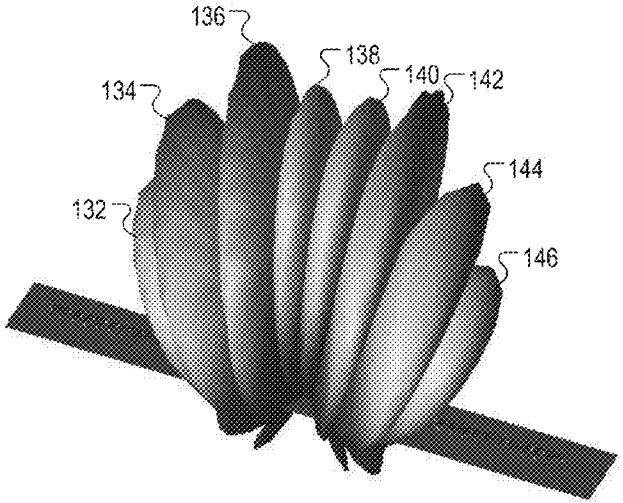
FIG. 1D shows a 3D radiation pattern graph with different radiation angles according to one embodiment.
Figure 1C:
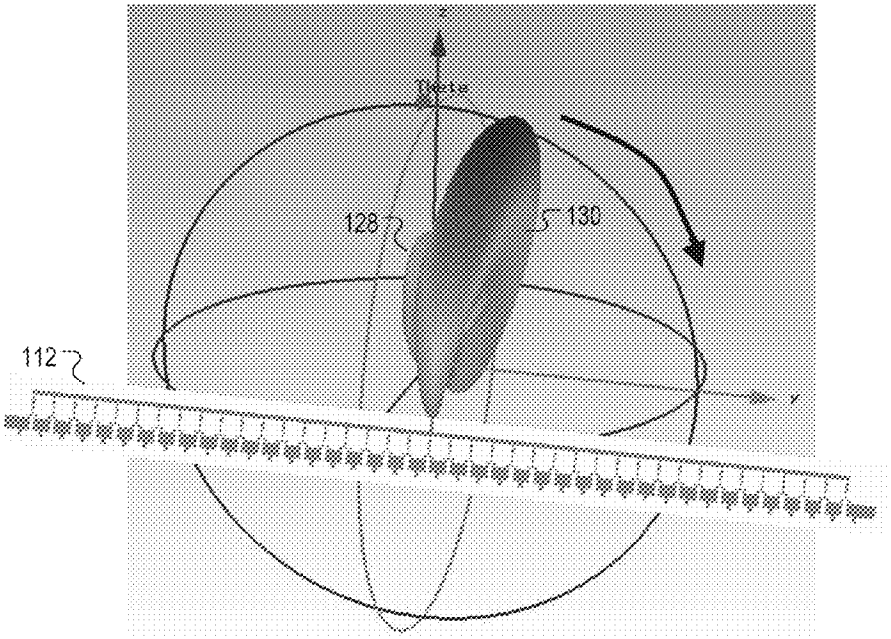
FIG. 1C shows a three-dimensional (3D) radiation pattern graph with multiple radiation angles according to one embodiment.

FIG. 1C shows a three-dimensional (3D) radiation pattern graph with multiple radiation angles according to one embodiment. Some numbers in FIG. 1C are similar to some numbers in FIG. 1A as noted by similar reference numbers unless expressly described otherwise. In one example, the controller 110 can set the radiation angle of the one or more LWA cell groups 114-118 to a first angle 128 using a first control signal. The controller 110 can then set the radiation angle of the one or more of the LWA cell groups 114-118 to a second angle 130 using a second control signal. The control signal can change the radiation angle along one or more of the x-axis, the y-axis, or the z-axis.

FIG. 1D shows a three-dimensional (3D) radiation pattern graph with different radiation angles 132-146 according to one embodiment. In one example, the controller 110 can set the radiation angle of the one or more of the LWA cell groups 114-118 to different radiation angles 132-146 using different control signals. In one example, the radiation angles 132-146 can span along the x-axis in selected increments, such as 10 degree increments.

Figure 2:
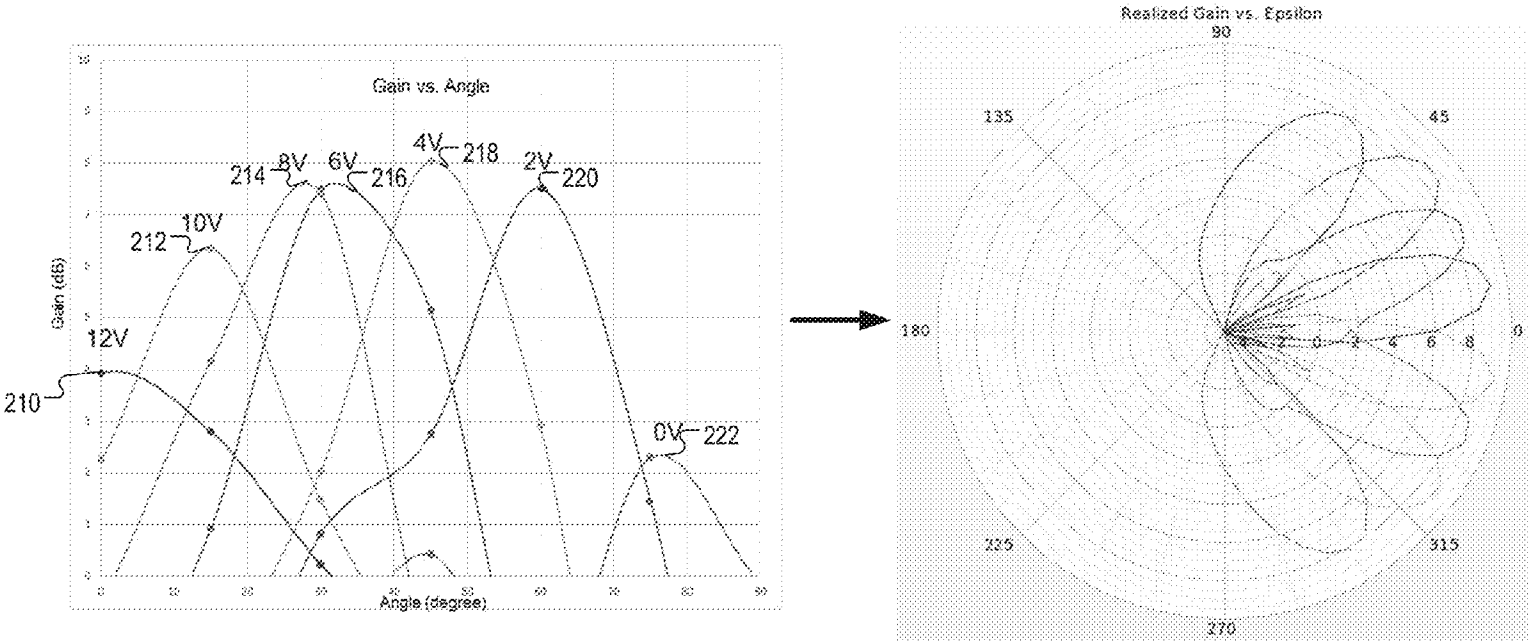
FIG. 2 shows a graph of radiation angles associated with various control signals according to one embodiment.

FIG. 2 shows a graph of radiation angles associated with various control signals 210-222 according to one embodiment. In one example, the controller 110 can set a radiation angle for the LWA cells 104 in the LWA cell group 116 by applying different voltage biases to the tunable components of the LWA cells 104. The controller can look up a voltage bias associated with an angle in a look up table and set the voltage bias for a given angle.

In one example, the controller 110 can set the radiation angle of the phased array antenna structure 100 to 0 degrees by sending a control signal set to a voltage bias of 12 volts. In another example, the controller 110 can set the radiation angle of the phased array antenna structure 100 to 15 degrees by sending a control signal set to a voltage bias of 10 volts. In another example, the controller 110 can set the radiation angle of the phased array antenna structure 100 to 27 degrees by sending a control signal set to a voltage bias of 8 volts. In another example, the controller 110 can set the radiation angle of the phased array antenna structure 100 to 32 degrees by sending a control signal set to a voltage bias of 6 volts. In another example, the controller 110 can set the radiation angle of the phased array antenna structure 100 to 45 degrees by sending a control signal set to a voltage bias of 4 volts. In another example, the controller 110 can set the radiation angle of the phased array antenna structure 100 to 60 degrees by sending a control signal set to a voltage bias of 2 volts. In another example, the controller 110 can set the radiation angle of the phased array antenna structure 100 to 75 degrees by sending a control signal set to a voltage bias of 0 volts.

The LWA cells 104 of the LWA cell group 102 can have a variety of configurations that the controller 110 can adjust to set the radiation angle of the phased array antenna structure 100. For example, the tunable components of the LWA cells 104 can include fixed capacitors or inductors, variable capacitors or variable inductors, barium strontium titanate (BST) variable capacitors, varactors, diodes, and/or micro-electro-mechanical systems (MEMS) capacitors.

Figure 3:
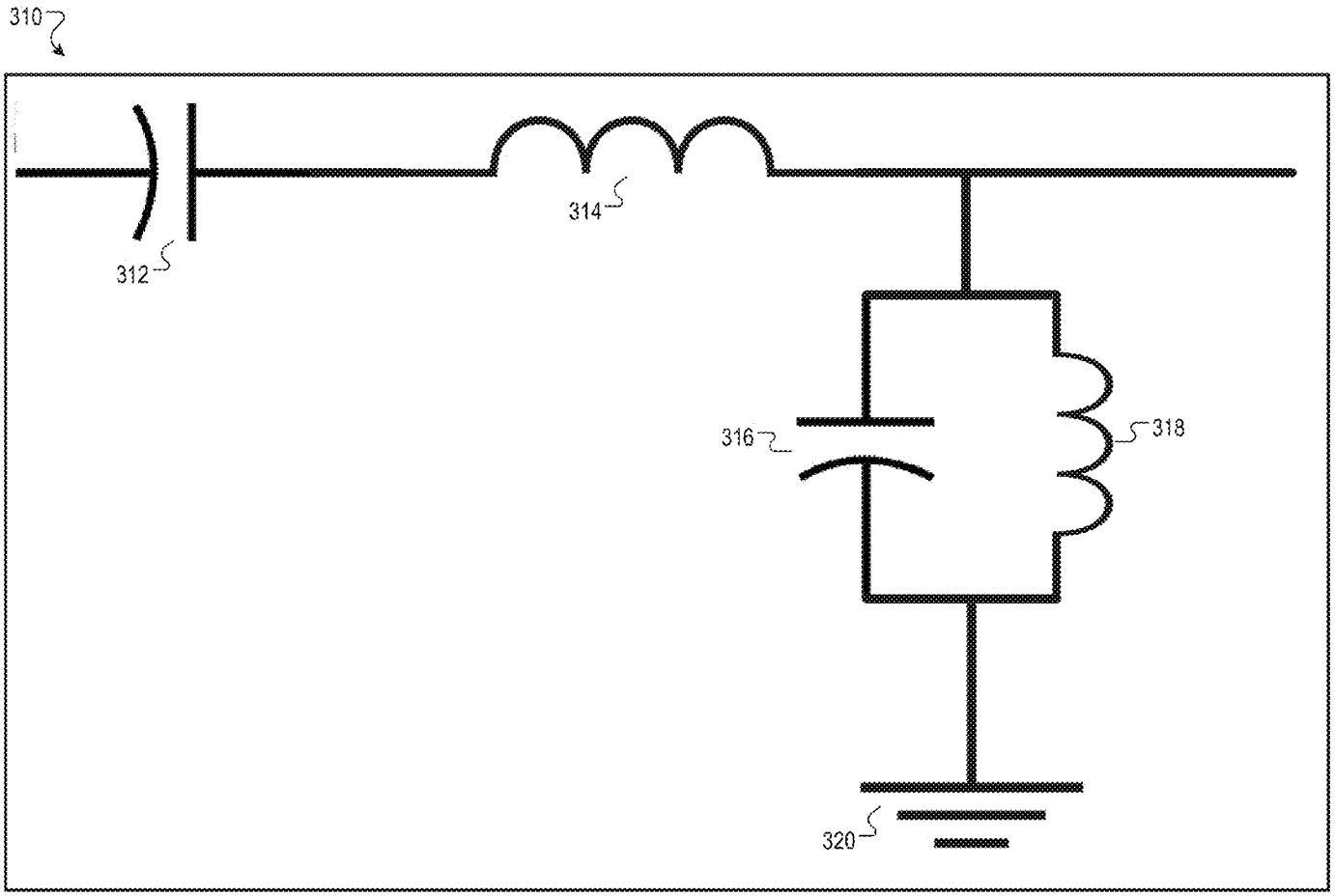
FIG. 3 shows a schematic representation of a composite right hand left hand (CRLH) LWA cell of the phased array antenna structure according to one embodiment.

FIG. 3 shows a schematic representation of a composite right hand left hand (CRLH) LWA cell 310 of the phased array antenna structure 100 according to one embodiment. The CRLH LWA cell 310 can include a left hand capacitor (CL) 312, a right hand inductor (LR) 314, a right hand capacitor (CR) 316, and a left hand inductor (LL) 318. The CL 312 and LR 314 can be connected together in a series and coupled to the CR 316 and LL 318 that can be connected in parallel and coupled to the ground 320 In one example, a capacitor value or an inductor value of the CRLH LWA cell 310 can be changed to adjust a radiation angle of the phased array antenna structure 100. For example, a radiation beam direction or angle can be calculated using the following algorithm $\theta=\sin-1(\beta/k0)$, where $\beta$ is a propagation constant and k0 is a freespace wave number. The propagation constant $\beta$ can be a function of capacitance values for the CL 312 and the CR 318 and the inductance values of the LR 314 and the LL 320.

Figure 4:
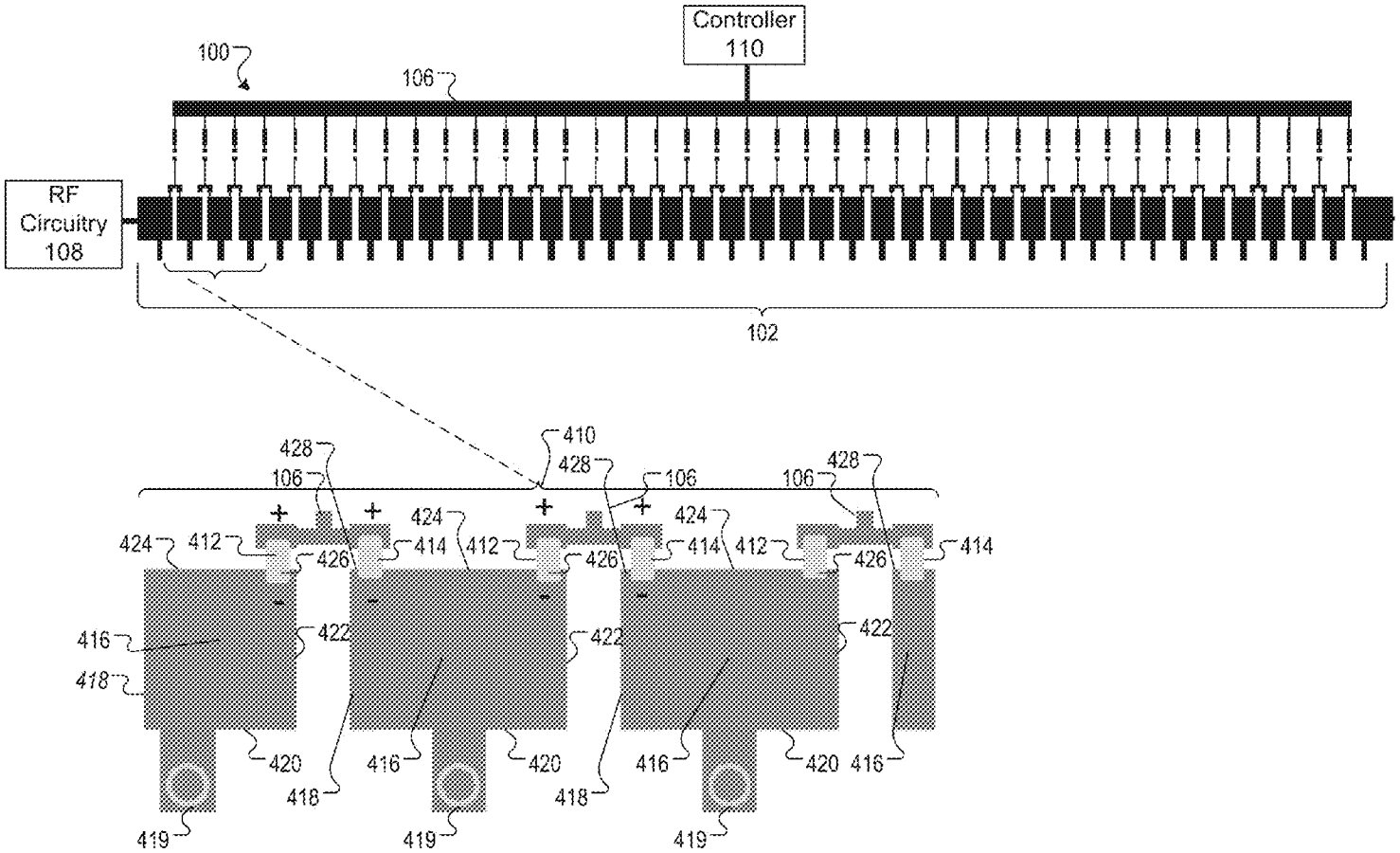
FIG. 4 shows the phased array antenna structure with LWA cells according to one embodiment.

FIG. 4 shows the phased array antenna structure 100 with LWA cells 410 according to one embodiment. Some numbers in FIG. 4 are similar to some numbers in FIG. 1A as noted by similar reference numbers unless expressly described otherwise. The LWA cells 410 can include a first tunable component 412, a second tunable component 414, and a conductive patch 416. In one example, the conductive patch 416 can have a polygon shape having multiple edges, such as a square or rectangle with a first edge (such as on a top edge of the conductive patch 416), a second edge (such as on a left edge of the conductive patch 416), a third edge (such as on a bottom edge of the conductive patch 416), and a fourth edge (such as on a right edge of the conductive patch 416). In another example, the conductive patch 416 can have an oval shape having a circumference and a diameter. The shape of the conductive patch 416 is not intended to be limiting and the conductive patch 416 can be a variety of different shapes.

The conductive patch 416 can be coupled to an RF feed of the RF circuitry 108 on a first side 418 of the conductive patch 416. The conductive patch 416 can be coupled to a ground plane through a via 419 on a second side 420 of the conductive patch 416. The conductive patch 416 can be coupled to the first tunable component 412 at a first corner 426 between a third side 422 and a fourth side 424 of the conductive patch 416. In one example, the first tunable component 412 is coupled between the conductive patch 416 and the strip 106. In another example, the first tunable component 412 is coupled between the conductive patch 416 and a contact terminal of the strip 106. The conductive patch 416 can be coupled to the second tunable component 414 at a second corner 428 between the first side 418 and the fourth side 424 of the conductive patch 416. In one example, the second tunable component 414 is coupled between the conductive patch 416 and the strip 106. In another example, the second tunable component 414 is coupled between the conductive patch 416 and the contact terminal that is coupled to the strip 106. In one embodiment, the first side 418 and the third side 422 can each be approximately 4 millimeters (mm) in length and the second side 420 and the fourth side 424 can each be 3 mm in length. The via 419 can protrude from the second side 420. The via 419 can be approximately 1.5 mm in length.

The first tunable component 412 and the second tunable component 414 can be diodes with a positive polarization on a side of the diode coupled to the strip 106 and a negative polarization on the side of the diode coupled to the conductive patch 416. The diodes can act as a variable capacitor. In another example, first tunable component 412 and the second tunable component 414 can be fixed Hi-Q capacitors.

In one example, the phased array antennas structure 100 can be configured to communicate at approximately a 5-6 GHz frequency. The phased array antenna structure 100 can radiate a one dimensional (1D) fan beam. The controller 110 can adjust the first and second tunable components 412 and 414 to change an angle of the 1D fan beam. For example, the controller can adjust the angle (theta) between 0 to 75 degrees that electromagnetic energy is radiated. In one example, the first tunable component 412 and the second tunable component 414 can act as a capacitor in the LWA cell 104.

Figure 5:
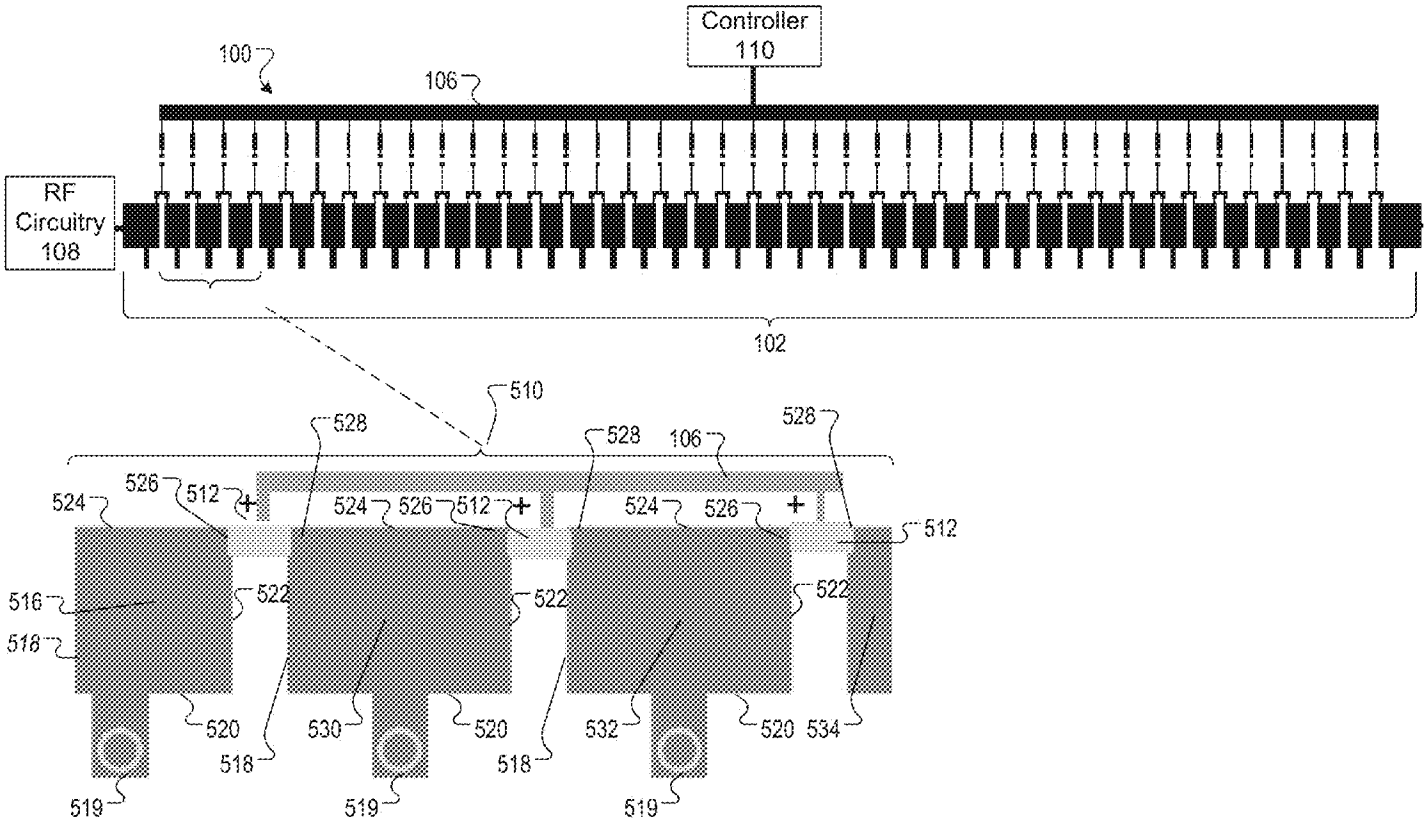
FIG. 5 shows the phased array antenna structure with LWA cells according to one embodiment.

FIG. 5 shows the phased array antenna structure 100 with LWA cells 510 according to one embodiment. Some numbers in FIG. 5 are similar to some numbers in FIG. 1A as noted by similar reference numbers unless expressly described otherwise. The LWA cells 510 can include a tunable component 512, and a first conductive patch 516, a second conductive patch 530, a third conductive patch 532, and a fourth conductive patch 534. In one example, the conductive patch 416 can have a polygon shape having multiple edges, such as a square or rectangle with a first edge (such as on a top edge of the conductive patch 416), a second edge (such as on a left edge of the conductive patch 416), a third edge (such as on a bottom edge of the conductive patch 416), and a fourth edge (such as on a right edge of the conductive patch 416). In another example, the conductive patch 416 can have an oval shape having a circumference and a diameter. The shape of the conductive patch 416 is not intended to be limiting and the conductive patch 416 can be a variety of different shapes.

The conductive patch 516 can be coupled to an RF feed of the RF circuitry 108 on a first side 518 of the conductive patch 516. The first conductive patch 516 can be coupled to a ground plane through a via 519 on a second side 520 of the first conductive patch 516. The first conductive patch 516 can be coupled to the tunable component 512 at a first corner 526 between a third side 522 and a fourth side 524 of the first conductive patch 516. The tunable component 512 can be coupled to the second conductive patch 530 at a second corner 528 of the second conductive patch 530. The third conductive patch 532 and the fourth conductive patch 534 can be coupled by the tunable component 512 similarly to the first conductive patch 516 and the second conductive patch 530. The tunable component 512 can be a Barium Strontium Titanate (BST) tunable capacitor. The BST tunable capacitor may not have a positive and negative polarization and can be as a variable capacitor. In one embodiment, the BST material of the BST tunable capacitor can have a default dielectric constant. As a dielectric constant of the BST material changes (such as when a voltage bias is applied), a capacitance of the BST tunable capacitor can change.

Figure 6:
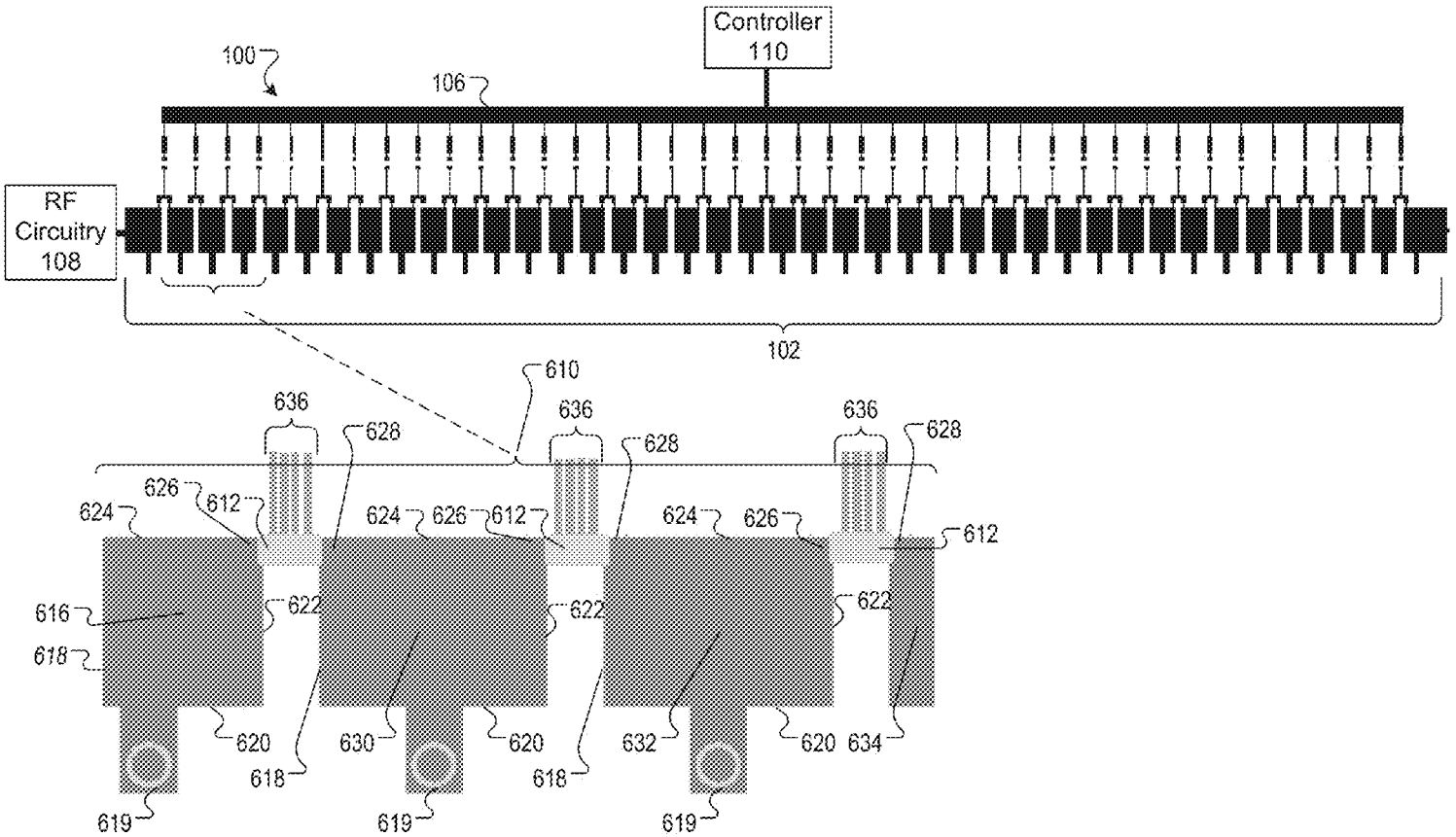
FIG. 6 shows the phased array antenna structure with LWA cells according to one embodiment.

FIG. 6 shows the phased array antenna structure 100 with LWA cells 610 according to one embodiment. Some numbers in FIG. 6 are similar to some numbers in FIG. 1A as noted by similar reference numbers unless expressly described otherwise. The LWA cells 610 can include tunable components 612, a first conductive patch 616, a second conductive patch 630, a third conductive patch 632, and a fourth conductive patch 634. In one example, the conductive patch 616 can be a polygon shape having multiple edges, such as a square or rectangle with a top edge, a first side edge, a bottom edge, and a second side edge. In another example, the conductive patch 616 can be an oval shape having a circumference and a diameter. The shape of the conductive patch 616 is not intended to be limiting and the conductive patch 616 can be a variety of different shapes.

The conductive patch 616 can be coupled to an RF feed of the RF circuitry 108 on a first side 618 of the conductive patch 616. The conductive patch 616 can be coupled to a ground plane through a via 619 on a second side 620 of the conductive patch 616. The conductive patch 616 can be coupled to the tunable component 612 at a first corner 626 between a third side 622 and a fourth side 624 of the conductive patch 616. The tunable component 612 can be coupled to the second conductive patch 630 at a second corner 628 of the second conductive patch 630. The third conductive patch 632 and the fourth conductive patch 634 can be coupled by the tunable component 612 similar to the first conductive patch 616 and the second conductive patch 630. The tunable component 612 can be a micro-electro-mechanical systems (MEMS) tunable capacitor with digital control lines 636. The digital control lines 636 can be coupled to the controller 110. The controller 110 can adjust a capacitance value of the MEMS tunable capacitor to program a capacitance value of the MEMS tunable capacitor. One advantage of the tunable component 612 being the MEMS tunable capacitor can be to adjust the MEMS tunable capacitor digitally via digital control lines without varying a voltage bias. One advantage of the tunable component 612 being the MEMS tunable capacitor can be to decrease a loss of the phased array antenna structure 100.

Figure 7A:
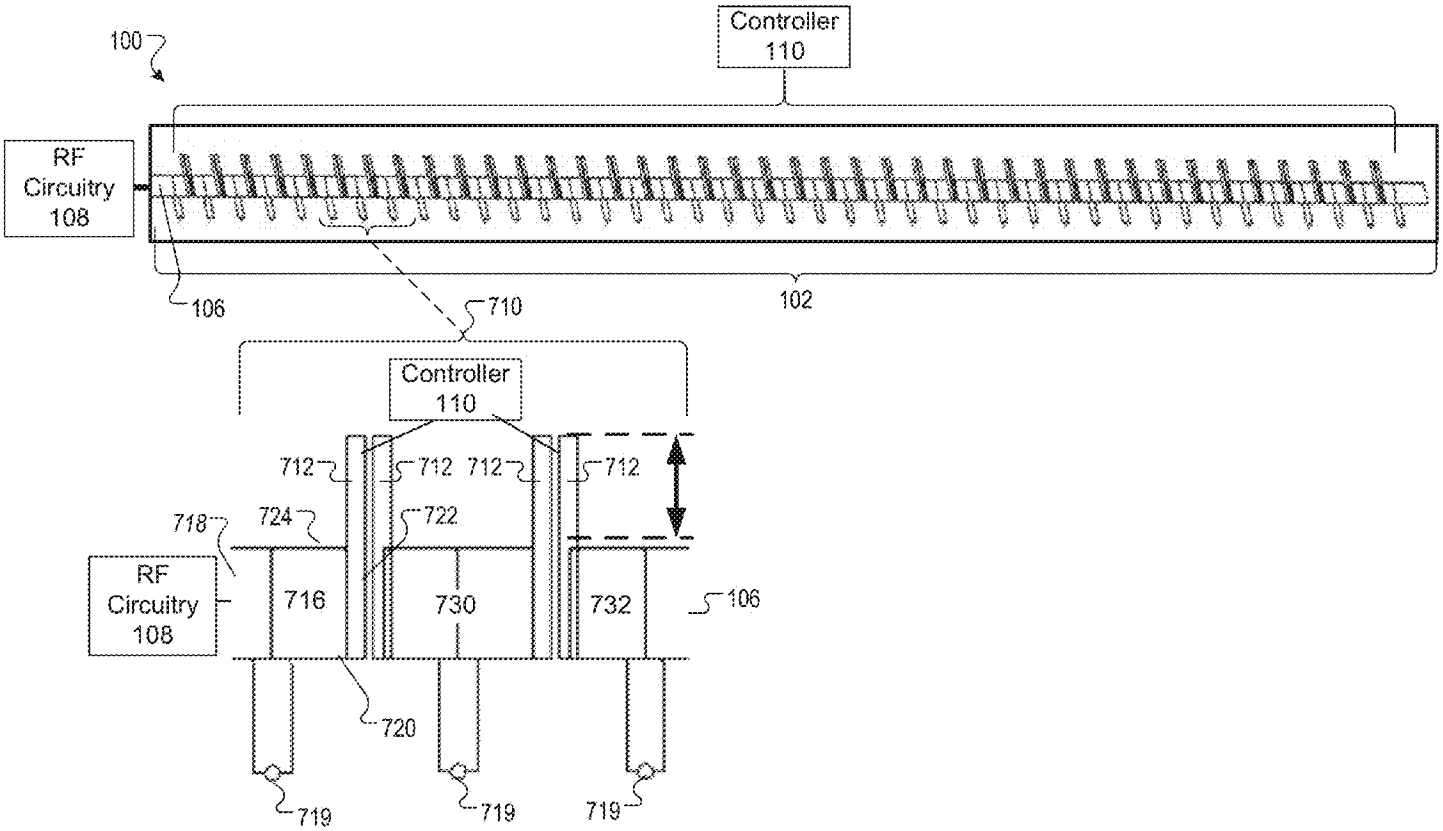
FIG. 7A shows the phased array antenna structure with LWA cells in an LWA cell group according to one embodiment.

FIG. 7A shows the phased array antenna structure 100 with LWA cells 710 in an LWA cell group 102 according to one embodiment. Some numbers in FIG. 7A are similar to some numbers in FIG. 1A as noted by similar reference numbers unless expressly described otherwise. The LWA cells 710 can be coupled to the strip 106 and can include a first conductive patch 716, a second conductive patch 730, and a third conductive patch 732. In one example, the conductive patch 716 or the conductive patch 730 can be a polygon shape having multiple edges, such as a square or rectangle with a top edge, a first side edge, a bottom edge, and a second side edge. An edge is a segment joining two vertices or corners of the polygonal shaped conductive patch 730. The edge may also be referred to as a boundary or side. In another example, the conductive patch 716 or the conductive patch 730 can be an oval shape having a circumference and a diameter. The shape of the conductive patch 716 or the conductive patch 730 is not intended to be limiting and the conductive patch 716 or the conductive patch 730 can be a variety of different shapes.

The first conductive patch 716 can be coupled to an RF feed of the RF circuitry 108 on a first side 718 of the conductive patch 716. The conductive patch 716 can be coupled to a ground plane through a via 719 on a second side 720 of the conductive patch 716. The conductive patch 716 can include a tunable portion 712 at a fourth side 724 of the conductive patch 716. The tunable portion 712 can be deformable material, such as deformable metal. A physical length of the deformable material can be changed by the controller 110 applying a voltage bias to the deformable material. The controller 110 can adjust a physical length of the deformable material of one or more of the LWA cells 710 to adjust an electromagnetic radiation angle of the phased array antenna structure 100, as discussed in greater detail in the proceeding paragraphs. The structure of the second conductive patch 730 and the third conductive patch 732 can be the same or substantially similar to the first conductive patch 716.

Figure 7B:
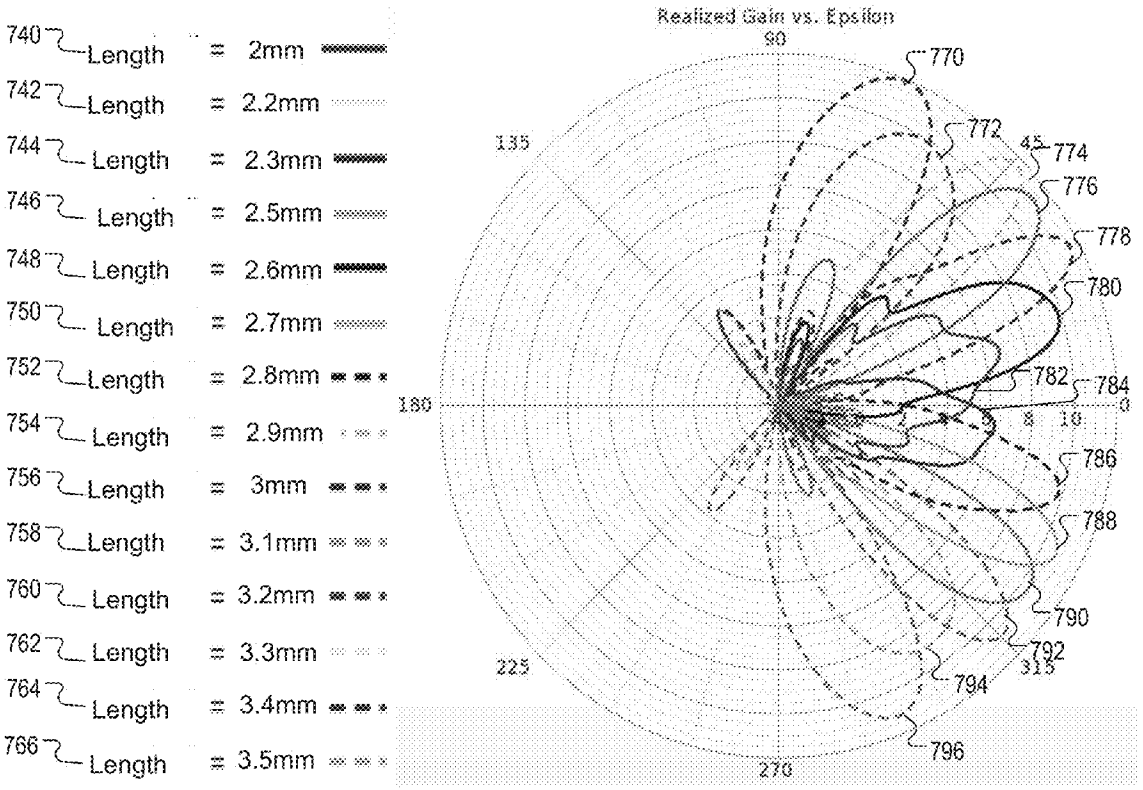
FIG. 7B shows a two-dimensional (2D) graph of different radiation angles associated with different physical lengths of a deformable material for a tunable portion of the LWA cells in FIG. 7A according to one embodiment.

FIG. 7B shows a two-dimensional (2D) graph of different radiation angles 770-796 associated with different physical lengths 740-766 of the deformable material for the tunable portion 712 of the LWA cells 710 in FIG. 7A according to one embodiment. In one example, when the controller 110 sets the physical length of the tunable portion 712 to be 2 millimeters (mm) (740) the radiation angle can be approximately a 10 degree angle (782). In another example, when the controller 110 sets the physical length of the tunable portion 712 to be 2.2 mm (742) the radiation angle can be approximately a −20 degree angle (788). In another example, when the controller 110 sets the physical length of the tunable portion 712 to be 2.3 mm (744) the radiation angle can be approximately a −5 degree angle (784). In another example, when the controller 110 sets the physical length of the tunable portion 712 to be 2.5 mm (746) the radiation angle can be approximately a 17 degree angle (780). In another example, when the controller 110 sets the physical length of the tunable portion 712 to be 2.6 mm (748) the radiation angle can be approximately a 40 degree angle (776). In another example, when the controller 110 sets the physical length of the tunable portion 712 to be 2.7 mm (750) the radiation angle can be approximately a −40 degree angle (790). In another example, when the controller 110 sets the physical length of the tunable portion 712 to be 2.8 mm (752) the radiation angle can be approximately a 70 degree angle (770). In another example, when the controller 110 sets the physical length of the tunable portion 712 to be 2.9 mm (754) the radiation angle can be approximately a 44 degree angle (774). In another example, when the controller 110 sets the physical length of the tunable portion 712 to be 3.0 mm (756) the radiation angle can be approximately a 35 degree angle (778). In another example, when the controller 110 sets the physical length of the tunable portion 712 to be 3.1 mm (758) the radiation angle can be approximately a −44 degree angle (792). In another example, when the controller 110 sets the physical length of the tunable portion 712 to be 3.2 mm (760) the radiation angle can be approximately a 60 degree angle (760). In another example, when the controller 110 sets the physical length of the tunable portion 712 to be 3.3 mm (762) the radiation angle can be approximately a 59 degree angle (794). In another example, when the controller 110 sets the physical length of the tunable portion 712 to be 3.4 mm (764) the radiation angle can be approximately a 11 degree angle (786). In another example, when the controller 110 sets the physical length of the tunable portion 712 to be 3.5 mm (766) the radiation angle can be approximately a −70 degree angle (796). The physical lengths of the tunable portion 712 and the angles associated with the physical lengths are not intended to be limiting and other physical lengths and angles can be used.

Figure 8B:
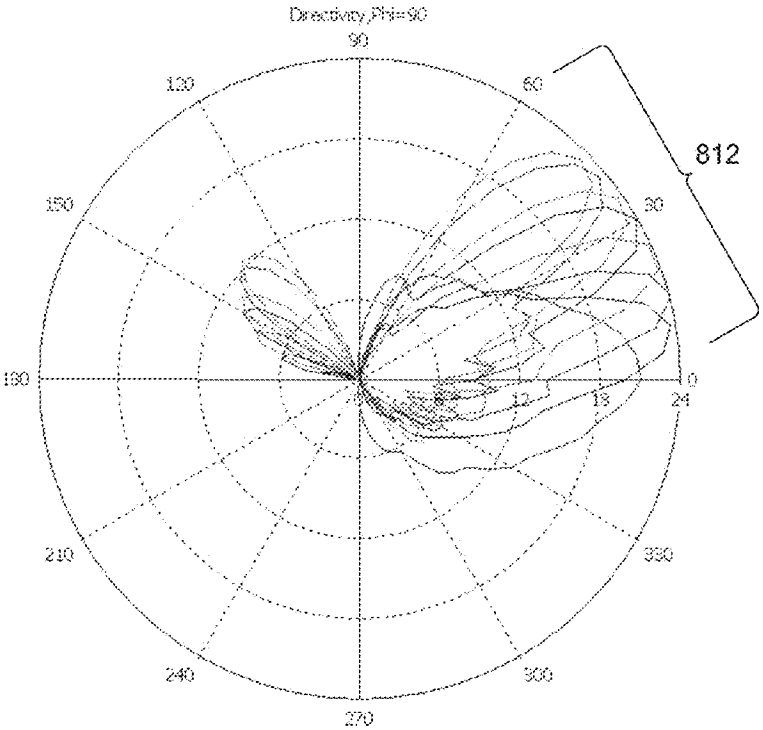
FIG. 8B shows a 2D radiation pattern graph showing different radiation angles for the phased array antenna structure in FIG. 8A according to one embodiment.
Figure 8A:
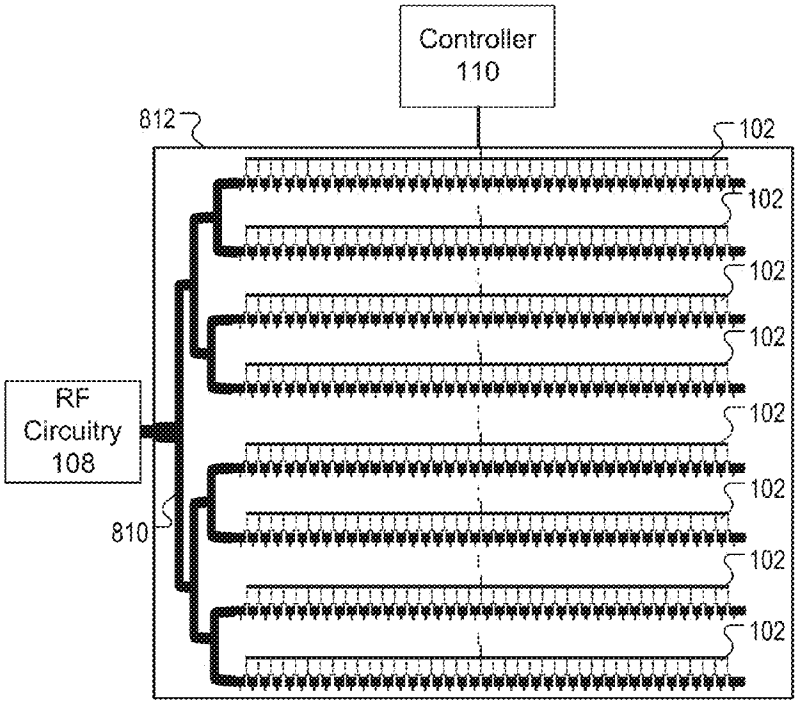
FIG. 8A illustrates the phased array antenna structure with multiple LWA cell groups according to one embodiment.

FIG. 8A illustrates the phased array antenna structure 100 with multiple LWA cell groups 102 according to one embodiment. Some numbers in FIG. 8A are similar to some numbers in FIG. 1A as noted by similar reference numbers unless expressly described otherwise. In one example, the phased array antenna structure 100 can include eight LWA cell groups 102. The eight LWA cell groups 102 can form a relatively highly directive pencil beam, such as a 24 decibel (dB) pencil beam. The phased array antenna structure 100 can include a substrate 812 (such as a dielectric substrate), where the multiple LWA cell groups 102 are integrated or attached to a top surface of the substrate 812. In one example, the substrate 812 can be 100-150 mm in length and 140 mm-160 mm in width.

The phased array antenna structure 100 can include RF circuitry 108 that can be coupled to each of the LWA cell groups 102. In one example, the RF circuitry 108 can include a power splitter/combiner 810 to send electromagnetic energy via the LWA cells of the LWA cell groups 102. In another example, the RF circuitry 108 can include a power splitter/combiner 810 to receive electromagnetic energy via the LWA cells of the LWA cell groups 102. For example, the power splitter/combiner 810 can split a defined amount of the electromagnetic energy when the RF circuitry 108 sends a signal to transmit using the phased array antenna structure 100. In another example, the power splitter/combiner 810 can combine a defined amount of the electromagnetic energy received by the phased array antenna structure 100, where the combined electromagnetic energy is sent to the RF circuitry 108. The phased array antenna structure 100 can include controller 110 that can be coupled to one or more of the LWA cell groups 102. In one embodiment, each LWA cell group 102 has a separate controller 110 or control line to receive a control signal for setting tunable components of the LWA cells of a respective LWA cell group 102. For example, a first LWA cell group 102 can receive a first control signal for a first radiation angle and a second LWA cell group 102 can receive a second control signal for a different radiation angle. In another example, each of the LWA cell groups 102 can receive the same control signal for a radiation angle. An advantage of the phased array antenna structure 100 including multiple LWA cell groups 102 can be to increase a directivity of the phased array antenna structure 100 where the multiple LWA cells 102 provide a higher fidelity of radiation angles.

FIG. 8B shows a 2D radiation pattern graph showing different radiation angles for the phased array antenna structure 100 in FIG. 8A according to one embodiment. The controller 110 can adjust the radiation angle of the phased array antenna structure 100 using different control signals.

For example, the controller 110 can change a capacitance value of a tunable component of one or more LWA cells in an LWA cell group 102. In one example, the radiation angle can range from approximately 0 degrees to 60 degrees (812).

Figure 8C:
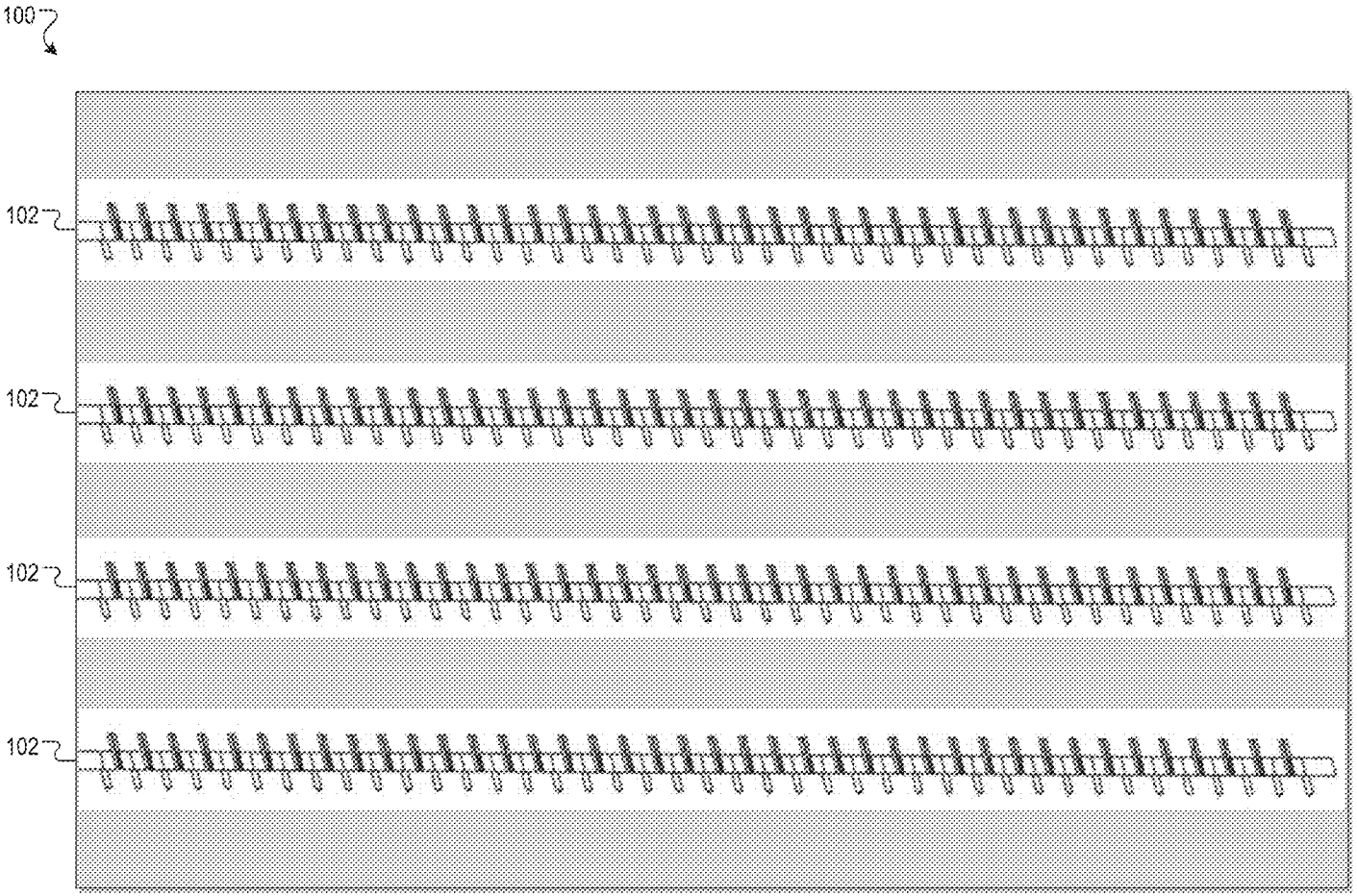
FIG. 8C illustrates the phased array antenna structure with multiple LWA cell groups according to one embodiment.

FIG. 8C illustrates the phased array antenna structure 100 with multiple LWA cell groups 102 according to one embodiment. Some numbers in FIG. 8C are similar to some numbers in FIGS. 1A, 7A, and 8A as noted by similar reference numbers unless expressly described otherwise. The multiple LWA cell groups 102 can include tunable portions that are deformable material, as discussed in the preceding paragraphs. Each of the LWA cell groups 102 with the tunable portions that are deformable material are the same as the LWA cell group 102 in FIG. 7A. The multiple LWA cell groups 102 as the same structure in FIG. 8A.

Figure 9:
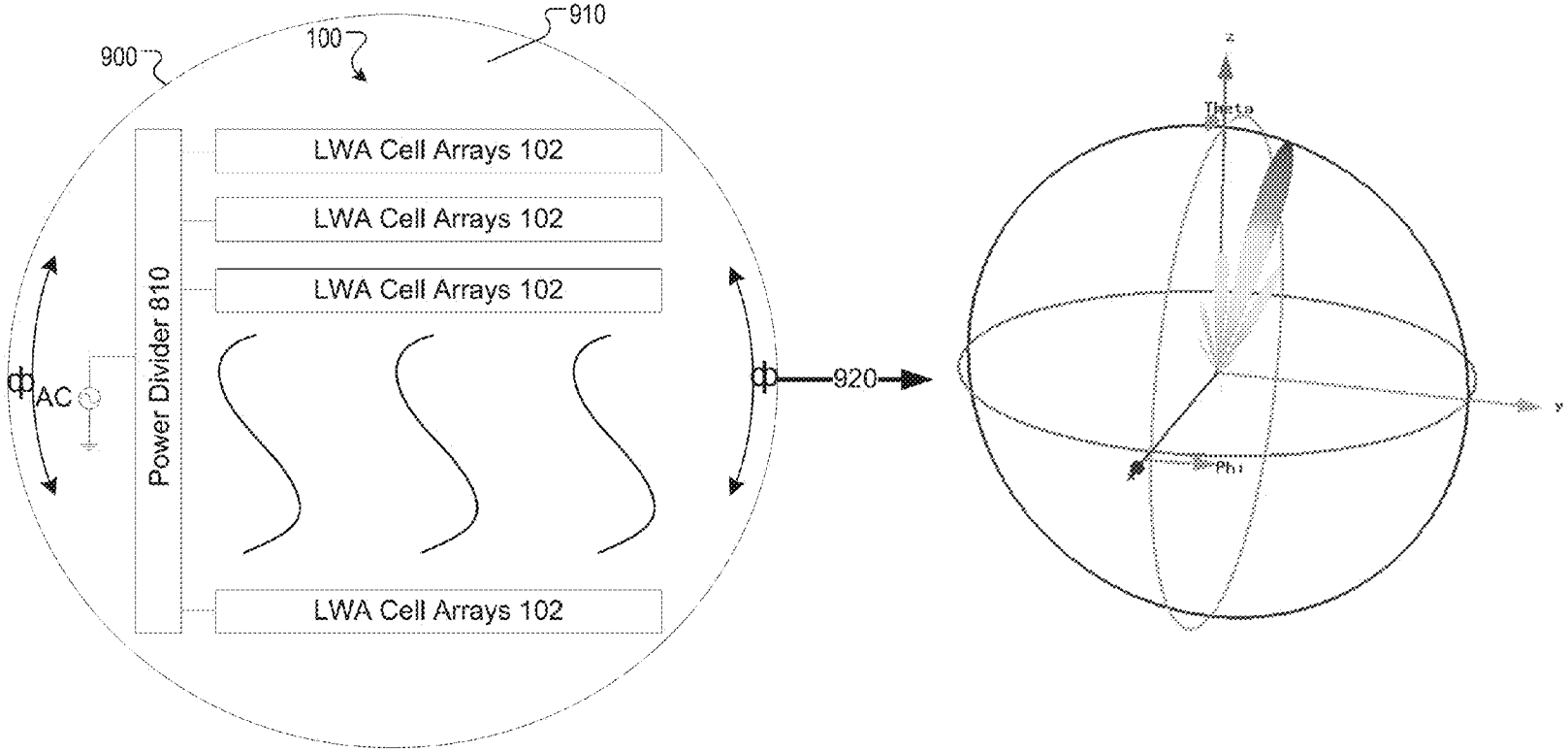
FIG. 9 illustrates the phased array antenna structure of FIG. 8A with a rotator to rotate the phased array antenna structure according to one embodiment.

FIG. 9 illustrates the phased array antenna structure 100 of FIG. 8A with a rotator 900 to rotate the phased array antenna structure 100 according to one embodiment. Some numbers in FIG. 9 are similar to some numbers in FIGS. 1A and 8A as noted by similar reference numbers unless expressly described otherwise. The phased array antenna structure 100 can include a substrate 910 where LWA call arrays 102 can be attached to a top side of the substrate 910. The rotator 900 can be attached to a bottom side of the substrate 910 and can rotate the substrate 910 in a clockwise or counterclockwise direction on a plane. In one example, the rotator 900 can be a mechanical rotator to rotate the phased array antenna structure 100 in order to adjust a radiation angle 920 of the phased array antenna structure 100 in two dimensions. In one embodiment, the phased array antenna structure 100 can radiate electromagnetic energy as a pencil beam, where the electromagnetic energy is a relatively narrow beam as compared to a fan beam. A rotation of the rotator 900 can be controlled by the controller 110. In one example, the controller 110 can adjust a radiation angle 920 of the antenna structure 100 on a first axis (such as an x axis) using the rotator 900 and can adjust the radiation angle for a second axis (such as a y-axis or a z-axis) by adjusting one or more LWA cell groups 102. The controller can combine adjusting the rotator 900 and the LWA cell groups 102 to enable 2D full-space beam steering.

Figure 10:
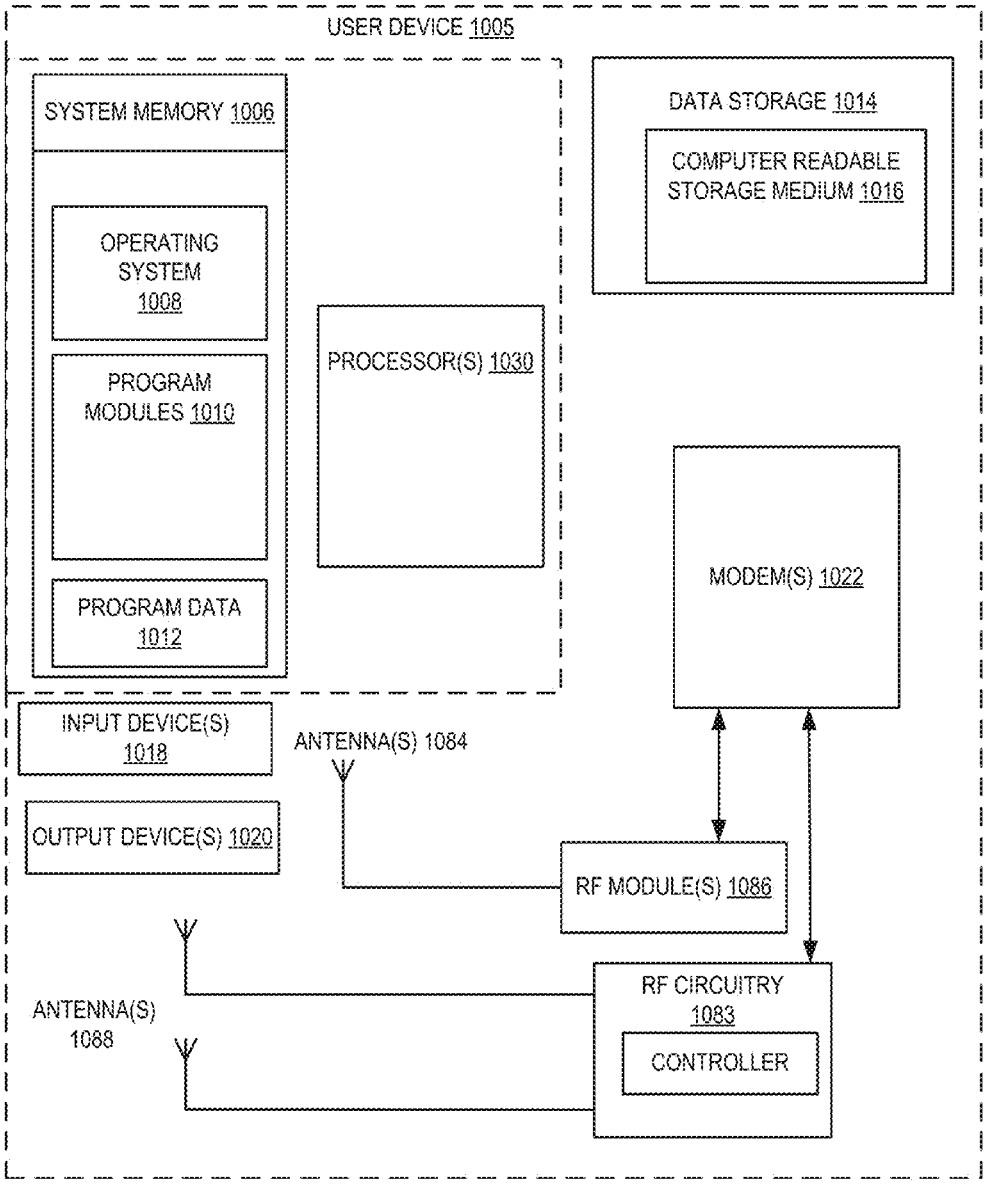
FIG. 10 is a block diagram of a user device in which embodiments of a radio device with the phased array antenna structure may be implemented.

FIG. 10 is a block diagram of a user device 1005 in which embodiments of a radio device with a phased array antenna structure may be implemented. The user device 1005 may correspond to the electronic device with a phased array antenna structure 100 of FIG. 1. The user device 1005 may be any type of computing device such as an electronic book reader, a PDA, a mobile phone, a laptop computer, a portable media player, a tablet computer, a camera, a video camera, a netbook, a desktop computer, a gaming console, a DVD player, a computing pad, a media center, and the like. The user device 1005 may be any portable or stationary user device. For example, the user device 1005 may be an intelligent voice control and speaker system. Alternatively, the user device 1005 can be any other device used in a WLAN network (e.g., WLAN network), a WAN network, or the like.

The user device 1005 includes one or more processor(s) 1030, such as one or more CPUs, microcontrollers, field programmable gate arrays, or other types of processors. The user device 1005 also includes system memory 1006, which may correspond to any combination of volatile and/or non-volatile storage mechanisms. The system memory 1006 stores information that provides operating system component 1008, various program modules 1010, program data 1012, and/or other components. In one embodiment, the system memory 1006 stores instructions. The user device 1005 performs functions by using the processor(s) 1030 to execute instructions provided by the system memory 1006.

The user device 1005 also includes a data storage device 1014 that may be composed of one or more types of removable storage and/or one or more types of non-removable storage. The data storage device 1014 includes a computer-readable storage medium 1016 on which is stored one or more sets of instructions embodying any of the methodologies or functions described herein. Instructions for the program modules 1010 may reside, completely or at least partially, within the computer-readable storage medium 1016, system memory 1006 and/or within the processor(s) 1030 during execution thereof by the user device 1005, the system memory 1006 and the processor(s) 1030 also constituting computer-readable media. The user device 1005 may also include one or more input devices 1018 (keyboard, mouse device, specialized selection keys, etc.) and one or more output devices 1020 (displays, printers, audio output mechanisms, etc.).

The user device 1005 further includes a modem 1022 to allow the user device 1005 to communicate via a wireless network (e.g., such as provided by the wireless communication system) with other computing devices, such as remote computers, an item providing system, and so forth. The modem 1022 can be connected to RF circuitry 1083 and zero or more RF modules 1086. The RF circuit 1083 may include a controller 1085, as described herein. The controller 1083 controls the adaptive neutralization line 160 to reduce the mutual coupling between the antennas 1088, which increase isolation between the antennas 1088 as described herein. The RF circuitry 1083 may be a WLAN module, a WAN module, PAN module, or the like. Antennas 1088 are coupled to the RF circuitry 1083, which is coupled to the modem 1022. Zero or more antennas 1084 can be coupled to one or more RF modules 1086, which are also connected to the modem 1022. The zero or more antennas 1084 may be GPS antennas, NFC antennas, other WAN antennas, WLAN or PAN antennas, or the like. The modem 1022 allows the user device 1005 to handle both voice and non-voice communications (such as communications for text messages, multimedia messages, media downloads, web browsing, etc.) with a wireless communication system. The modem 1022 may provide network connectivity using any type of mobile network technology including, for example, cellular digital packet data (CDPD), general packet radio service (GPRS), EDGE, universal mobile telecommunications system (UMTS), 1 times radio transmission technology (1×RTT), evaluation data optimized (EVDO), high-speed down-link packet access (HSDPA), Wi-Fi®, Long Term Evolution (LTE) and LTE Advanced (sometimes generally referred to as 4G), etc.

The modem 1022 may generate signals and send these signals to antenna 1088, and 1084 via RF circuitry 1083 and RF module(s) 1086 as descried herein. User device 1005 may additionally include a WLAN module, a GPS receiver, a PAN transceiver and/or other RF modules. These RF modules may additionally or alternatively be connected to one or more of antennas 1084, 1088. Antennas 1084, 1088 may be configured to transmit in different frequency bands and/or using different wireless communication protocols. The antennas 1084, 1088 may be directional, omnidirectional, or non-directional antennas. In addition to sending data, antennas 1084, 1088 may also receive data, which is sent to appropriate RF modules connected to the antennas.

In one embodiment, the user device 1005 establishes a first connection using a first wireless communication protocol, and a second connection using a different wireless communication protocol. The first wireless connection and second wireless connection may be active concurrently, for example, if a user device is downloading a media item from a server (e.g., via the first connection) and transferring a file to another user device (e.g., via the second connection) at the same time. Alternatively, the two connections may be active concurrently during a handoff between wireless connections to maintain an active session (e.g., for a telephone conversation). Such a handoff may be performed, for example, between a connection to a WLAN hotspot and a connection to a wireless carrier system. In one embodiment, the first wireless connection is associated with a first resonant mode of an antenna structure that operates at a first frequency band and the second wireless connection is associated with a second resonant mode of the antenna structure that operates at a second frequency band. In another embodiment, the first wireless connection is associated with a first antenna element and the second wireless connection is associated with a second antenna element. In other embodiments, the first wireless connection may be associated with a media purchase application (e.g., for downloading electronic books), while the second wireless connection may be associated with a wireless ad hoc network application. Other applications that may be associated with one of the wireless connections include, for example, a game, a telephony application, an Internet browsing application, a file transfer application, a global positioning system (GPS) application, and so forth.

Though a modem 1022 is shown to control transmission and reception via antenna (1084, 1088), the user device 1005 may alternatively include multiple modems, each of which is configured to transmit/receive data via a different antenna and/or wireless transmission protocol.

The user device 1005 delivers and/or receives items, upgrades, and/or other information via the network. For example, the user device 1005 may download or receive items from an item providing system. The item providing system receives various requests, instructions and other data from the user device 1005 via the network. The item providing system may include one or more machines (e.g., one or more server computer systems, routers, gateways, etc.) that have processing and storage capabilities to provide the above functionality. Communication between the item providing system and the user device 1005 may be enabled via any communication infrastructure. One example of such an infrastructure includes a combination of a wide area network (WAN) and wireless infrastructure, which allows a user to use the user device 1005 to purchase items and consume items without being tethered to the item providing system via hardwired links. The wireless infrastructure may be provided by one or multiple wireless communications systems, such as one or more wireless communications systems. One of the wireless communication systems may be a wireless local area network (WLAN) hotspot connected with the network. The WLAN hotspots can be created by products based on IEEE 802.11x standards for the Wi-Fi® technology by Wi-Fi® Alliance. Another of the wireless communication systems may be a wireless carrier system that can be implemented using various data processing equipment, communication towers, etc. Alternatively, or in addition, the wireless carrier system may rely on satellite technology to exchange information with the user device 1005.

The communication infrastructure may also include a communication-enabling system that serves as an intermediary in passing information between the item providing system and the wireless communication system. The communication-enabling system may communicate with the wireless communication system (e.g., a wireless carrier) via a dedicated channel, and may communicate with the item providing system via a non-dedicated communication mechanism, e.g., a public Wide Area Network (WAN) such as the Internet.

The user devices 1005 are variously configured with different functionality to enable consumption of one or more types of media items. The media items may be any type of format of digital content, including, for example, electronic texts (e.g., eBooks, electronic magazines, digital newspapers, etc.), digital audio (e.g., music, audible books, etc.), digital video (e.g., movies, television, short clips, etc.), images (e.g., art, photographs, etc.), and multi-media content. The user devices 1005 may include any type of content rendering devices such as electronic book readers, portable digital assistants, mobile phones, laptop computers, portable media players, tablet computers, cameras, video cameras, netbooks, notebooks, desktop computers, gaming consoles, DVD players, media centers, and the like.

In the above description, numerous details are set forth. It will be apparent, however, to one of ordinary skill in the art having the benefit of this disclosure, that embodiments may be practiced without these specific details. In some instances, well-known structures and devices are shown in block diagram form, rather than in detail, in order to avoid obscuring the description.

Some portions of the detailed description are presented in terms of algorithms and symbolic representations of operations on data bits within a computer memory. These algorithmic descriptions and representations are the means used by those skilled in the data processing arts to most effectively convey the substance of their work to others skilled in the art. An algorithm is here, and generally, conceived to be a self-consistent sequence of steps leading to a desired result. The steps are those requiring physical manipulations of physical quantities. Usually, though not necessarily, these quantities take the form of electrical or magnetic signals capable of being stored, transferred, combined, compared, and otherwise manipulated. It has proven convenient at times, principally for reasons of common usage, to refer to these signals as bits, values, elements, symbols, characters, terms, numbers or the like.

It should be borne in mind, however, that all of these and similar terms are to be associated with the appropriate physical quantities and are merely convenient labels applied to these quantities. Unless specifically stated otherwise as apparent from the above discussion, it is appreciated that throughout the description, discussions utilizing terms such as "inducing," "parasitically inducing," "radiating," "detecting," determining," "generating," "communicating," "receiving," "disabling," or the like, refer to the actions and processes of a computer system, or similar electronic computing device, that manipulates and transforms data represented as physical (e.g., electronic) quantities within the computer system's registers and memories into other data similarly represented as physical quantities within the computer system memories or registers or other such information storage, transmission or display devices.

Embodiments also relate to an apparatus for performing the operations herein. This apparatus may be specially constructed for the required purposes, or it may comprise a general-purpose computer selectively activated or reconfigured by a computer program stored in the computer. Such a computer program may be stored in a computer readable storage medium, such as, but not limited to, any type of disk including floppy disks, optical disks, CD-ROMs and magnetic-optical disks, read-only memories (ROMs), random access memories (RAMs), EPROMs, EEPROMs, magnetic or optical cards, or any type of media suitable for storing electronic instructions.

The algorithms and displays presented herein are not inherently related to any particular computer or other apparatus. Various general-purpose systems may be used with programs in accordance with the teachings herein, or it may prove convenient to construct a more specialized apparatus to perform the required method steps. The required structure for a variety of these systems will appear from the description below. In addition, the present embodiments are not described with reference to any particular programming language. It will be appreciated that a variety of programming languages may be used to implement the teachings of the present invention as described herein. It should also be noted that the terms "when" or the phrase "in response to," as used herein, should be understood to indicate that there may be intervening time, intervening events, or both before the identified operation is performed.

It is to be understood that the above description is intended to be illustrative, and not restrictive. Many other embodiments will be apparent to those of skill in the art upon reading and understanding the above description. The scope of the present embodiments should, therefore, be determined with reference to the appended claims, along with the full scope of equivalents to which such claims are entitled.

What is claimed is:

1. An electronic device comprising:

radio frequency (RF) circuitry comprising an RF feed;

a phased array antenna structure comprising:

a ground plane;

a non-radiating conductive strip;

an array of leaky-wave antenna (LWA) cells individually coupled to respective locations on the non-radiating conductive strip and individually coupled to the ground plane through respective vias, wherein the array of LWA cells comprises a first LWA cell and a second LWA cell, wherein:

the first LWA cell comprises:

a first tunable component; and a first conductive patch having a polygonal shape coupled to the RF feed on a first edge of the first conductive patch, coupled to the ground plane through a first via on a second edge of the first conductive patch, and coupled to the first tunable component at a first corner between a third edge and a fourth edge of the first conductive patch;

the second LWA cell comprises a second conductive patch having a polygonal shape coupled to the ground plane through a second via on a second edge of the second conductive patch and coupled to the first tunable component at a first corner between a first edge and a third edge of the second conductive patch; and a controller coupled to the non-radiating conductive strip, the controller to generate a control signal to set a voltage value of the first tunable component, wherein the RF circuitry is operable to set, using the control signal, the voltage value of the first tunable component to a first voltage value correlated to a first radiation angle of the phased array antenna structure and apply a first current to the RF feed to cause to the phased array antenna structure to radiate electromagnetic energy at the first radiation angle, wherein the RF circuitry is operable to set, using the control signal, the voltage value of the tunable component to a second voltage value correlated to a second radiation angle of the phased array antenna structure and apply a second current to the RF feed to cause to the phased array antenna structure to radiate electromagnetic energy at the second radiation angle.

2. The electronic device of claim 1, wherein:

the second LWA cell comprises a second tunable component coupled between a second corner between the third edge and a fourth edge of the second conductive patch, and the array of LWA cells comprises a third LWA cell comprising a third conductive patch having a polygonal shape coupled to the ground plane through a third via on a second side of the third conductive patch and coupled to the second tunable component at a first corner between a first side and a third side of the third conductive patch.

3. The electronic device of claim 2, wherein the first tunable component comprises:

a first variable capacitor coupled between a contact terminal of the non-radiating conductive strip and the first corner of the first conductive patch; and a second variable capacitor coupled between the contact terminal and the first corner of the second conductive patch.

4. The electronic device of claim 2, wherein:

the first tunable component is a first varactor diode or a first Barium Strontium Titanate (BST) tunable capacitor and the second tunable component is a second varactor diode or a second BST tunable capacitor, and the control signal is a bias voltage for the first or second varactor diodes or the first and second BST tunable capacitors.

5. An electronic device comprising:

radio frequency (RF) circuitry comprising an RF feed;

an antenna structure comprising:

a ground plane;

a first strip;

an first array of leaky-wave antenna (LWA) cells individually coupled to respective locations on the first strip and individually coupled to the ground plane through respective vias, wherein the array of LWAs cells comprises a first LWA cell and a second LWA cell, wherein:

the first LWA cell comprises:

a first tunable component; and a first conductive patch coupled to the RF feed on a first edge of the first conductive patch and coupled to the first tunable component at a first corner between a third edge and a fourth edge of the first conductive patch;

the second LWA cell comprises a second conductive patch coupled to the first tunable component at a first corner between a first edge and a third edge of the second conductive patch; and a controller coupled to the first strip, the controller to generate a control signal to set a variable value of the tunable component to a first voltage value correlated to a first radiation angle of the antenna structure.

6. The electronic device of claim 5, wherein:

the second LWA cell comprises a second tunable component coupled between a second corner between the third edge and a fourth edge of the second conductive patch, and the array of LWA cells comprises a third LWA cell comprising a third conductive patch coupled to the ground plane through a third via on a second edge of the third conductive patch and coupled to the second tunable component at a first corner between a first edge and a third edge of the third conductive patch.

7. The electronic device of claim 6, wherein:

the first tunable component is a first Micro-Electro-Mechanical Systems (MEMS) tunable capacitor, the second tunable component is a second MEMS tunable capacitor, and the control signal is a digital control signal for the first MEMS tunable capacitor and the second MEMS tunable capacitor.

8. The electronic device of claim 6, wherein the first strip further comprises a plurality of control lines, and wherein the first tunable component is coupled to a first set of the plurality of control lines and the second tunable component is coupled to a second set of the plurality of control lines.

9. The electronic device of claim 5, wherein:

the first conductive patch is coupled to the ground plane through a first via on a second edge of the first conductive patch, and the second conductive patch coupled to the ground plane through a second via on a second edge of the second conductive patch.

10. The electronic device of claim 5, wherein the RF circuitry is operable to:

set, using the control signal, the variable value of the first tunable component to the first voltage value correlated to the first radiation angle of the antenna structure;

apply a first current to the RF feed to cause to the antenna structure to radiate electromagnetic energy in a first direction;

set, using the control signal, the variable value of the tunable component to a second voltage value correlated to a second radiation angle of the antenna structure; and apply a second current to the RF feed to cause to the antenna structure to radiate electromagnetic energy in a second direction.

11. The electronic device of claim 5, the antenna structure further comprising:

a second strip coplanar to the first strip;

an second array of LWA cells individually coupled to respective locations on the second strip and individually coupled to the ground plane through respective vias, wherein the second array of LWAs cells comprises a third LWA cell and a fourth LWA cell, wherein:

the third LWA cell comprises:

a second tunable component; and a third conductive patch coupled to the RF feed on a first edge of the third conductive patch, coupled to the ground plane through a third via on a second edge of the third conductive patch, and coupled to the second tunable component at a first corner between a third edge and a fourth edge of the third conductive patch;

the fourth LWA cell comprises a fourth conductive patch coupled to the ground plane through a fourth via on a second edge of the fourth conductive patch and coupled to the second tunable component at a first corner between a first edge and a third edge of the fourth conductive patch; and the controller is coupled to the second strip, the controller to generate a second control signal to set a second variable value of the second tunable component to the first voltage value correlated to the first radiation angle of the antenna structure.

12. The electronic device of claim 11, wherein the RF circuitry is operable to set the second variable value of the second tunable component to a second voltage value correlated to a second radiation angle of the antenna structure.

13. The electronic device of claim 12, wherein:

the antenna structure further comprises a rotator coupled to a bottom surface of a dielectric substrate; and the controller is further configured to cause the rotator to rotate the dielectric substrate to adjust a plane of the first radiation angle of the electromagnetic energy.

14. The electronic device of claim 5, wherein:

the strip comprises a non-radiating conductive material; and the first and the second conductive patches comprise a radiating conductive material.

15. The electronic device of claim 5, the antenna structure further comprising a dielectric substrate comprising a top surface and a bottom surface, wherein:

the strip, the first LWA cell, and the second LWA cell are located on the top surface of the dielectric substrate; and the ground plane is located on the bottom surface of the dielectric substrate.

16. An antenna structure comprising:

a strip;

a first leaky-wave antenna (LWA) cell coupled to the strip comprises:

a tunable component; and a first conductive patch coupled to a radio frequency (RF) feed on a first edge of the first conductive patch, coupled to a ground plane through a first via on a second edge of the first conductive patch, and coupled to the tunable component at a first corner between a third edge and a fourth edge of the first conductive patch; and a second LWA cell comprises a second conductive patch coupled to the ground plane through a second via on a second edge of the second conductive patch and coupled to the tunable component at a first corner between a first edge and a third edge of the second conductive patch.

17. The antenna structure of claim 16, further comprising a dielectric substrate comprising a top surface and a bottom surface, wherein:

the strip, the first LWA cell, and the second LWA cell are located on a top surface of the dielectric substrate; and the ground plane is located on a bottom surface of the dielectric substrate.

18. The antenna structure of claim 16, wherein the first LWA cell and the second LWA cell are approximately a same shape and size.

19. The antenna structure of claim 16, wherein the tunable is made of a deformable material that varies in physical length as a current is applied to the deformable material.

20. The antenna structure of claim 16, wherein:

the tunable component is a varactor diode, a first Barium Strontium Titanate (BST) tunable capacitor, or a Micro-Electro-Mechanical Systems (MEMS) tunable capacitor, and the control signal is a voltage bias for the tunable component.

* * * * *